US005494157A

United States Patent [19]

Golenz et al.

[11] Patent Number: 5,494,157

[45] Date of Patent: Feb. 27, 1996

[54] COMPUTER BAG WITH SIDE ACCESSIBLE PADDED COMPARTMENTS

[75] Inventors: Douglas J. Golenz, Morrison; James A. Reiner, Denver; Jack W. Renforth, Aurora, all of Colo.; David E. Workman, Princeton, N.J.

[73] Assignee: Samsonite Corporation, Denver, Colo.

[21] Appl. No.: 339,366

[22] Filed: Nov. 14, 1994

[51] Int. Cl.[6] ..... B65D 85/30; A45C 3/02

[52] U.S. Cl. ..... 206/370; 190/111; 190/115; 206/521; 206/583

[58] Field of Search ..... 190/109, 111, 190/113, 115, 117, 127, 119; 206/305, 320, 521, 583

[56] References Cited

U.S. PATENT DOCUMENTS

| | | | |
|---|---|---|---|
| 2,837,132 | 6/1958 | Darst | 190/119 X |
| 3,136,408 | 6/1964 | Rockman | 206/320 X |
| 3,824,472 | 7/1974 | Engel et al. | 206/305 X |
| 3,870,132 | 3/1975 | Harley | 190/109 |
| 4,805,749 | 2/1989 | Gerch | 190/111 |
| 5,010,988 | 4/1991 | Brown | 206/320 X |
| 5,160,001 | 11/1992 | Marceau . | |
| 5,217,119 | 6/1993 | Hollingsworth | 206/583 |
| 5,423,404 | 6/1995 | Shaw | 190/111 X |

*Primary Examiner*—Bryon P. Gehman

*Attorney, Agent, or Firm*—Gregory W. O'Connor; Rod D. Baker

[57] ABSTRACT

Dozens of companies offer many different types of cases specifically designed to carry microcomputers. One type of microcomputer, the laptop style, can be carried by hand or from a shoulder strap in such cases. Unfortunately, as these microcomputers become more powerful tools for scientists, students, engineers, artists, and medical personnel, there is a ever greater need to protect these devices while enhancing their ready access and ease of use. These two conflicting requirements, easy removal from the carrying case, and superior protection from weather and impact, have not been adequately met by these several computer cases. This computer case provides a main packing space for the microcomputer defined by a "C" shaped rigid frame and corresponding shock absorbing pad, the forth side of the packing space is selectively closed by a padded access door. The handle and/or shoulder strap is riveted to the upper side of this "C" shaped frame. The access door is integrally hinged to the lower side of the frame, and is secured to the case when closed by double slide fastener and hook and loop fasteners.

17 Claims, 3 Drawing Sheets

COMPUTER BAG WITH SIDE ACCESSIBLE PADDED COMPARTMENTS

BACKGROUND OF THE INVENTION

This invention relates to shoulder or hand carried cases specifically designed to transport microcomputers or personal computers. More specifically, the subject invention deals with a construction of multi-compartmented computer cases. These computer cases serve to provide a convenient way to transport micro computers and to protect such micro computers from some of the rigors of travel and storage, for example, precipitation, dust, dirt, some vibration, and impact.

Microcomputers are relatively heavy and expensive, and can contain vast amounts of information which is vital to business and industry. Certain portions of the microcomputers are subject to damage from impact, for example, hard drives and liquid crystal displays. Thus, great effort has been expended to insulate microcomputers from impact when being carried in these cases.

Of course, one of the greatest utilities of a microcomputer is its portability, especially in comparison with the ubiquitous mini computer or desktop computer. Computer users who demand this portability also desire quick and easy access to that computer so that this computing and information storage power can be brought to bear at a moment's notice. Unfortunately, past attempts to isolate the microcomputer from impact shock have worked to frustrate this need for quick access.

An example of past transport and shock absorbing systems is shown in U.S. Pat. No. 5,217,119. There, a microcomputer is suspended in a sling-like device which in turn is contained within a central interior space of an otherwise relatively conventional "softside" main body portion of the case. This system absorbs at least some of the shock when the microcomputer contained in the sling-like suspension system is dropped onto its bottom surface. However, placing the microcomputer in the sling-like support enclosing the case can be cumbersome, thus frustrating some of the purposes for the user carrying the microcomputer (portability and accessibility).

The instant invention remedies this apparent conflict between security, protection, and accessibility without substantially increasing the weight of the microcomputer carrying case.

BRIEF DESCRIPTION OF THE INVENTION

Accordingly, disclosed is a carrying case for a microcomputer and the like. This case has a main body portion which has an interior space sized to hold the microcomputer. This interior space is defined by first and second end walls (corresponding to the major faces of a generally parallelopiped shaped microcomputer) and peripheral walls extending around the microcomputer and extending between the first and second end walls. Handle means for carrying the case's main body portion is firmly attached to the upper portion of the main body portion. An opening through which the microcomputer can be passed is provided into the interior space. There is a frame which has three generally straight sides and an open side. This frame is made of a generally stiff material with the three sides of the frame at least partially surrounding the interior space and extending along these peripheral walls. An open side is positioned below the upper portion of the case when the case is being carried by the handle or strap. The first and second end walls can themselves be provided with a foam pad. Additionally and alternatively, either or both of these end walls can be further provided with a cloth gusset to which is attached an outermost wall. Thus, the first or second end walls can provide a further pocket with access means, preferably in the top portion thereof to prevent access to these pockets.

A shock absorbing pad extends around the inside of the frame around the interior space. This shock absorbing pad preferably comprises an elongated tube-shaped membrane which is envelopes a compressible fill material. This tube-shaped membrane has an overall length substantially equal to the total length of the three sides of the rigid frame and the integral corner regions of the frame. This compressible media is preferably a closed cell foam which may comprise two layers of foam having different densities and compression characteristics from one another.

The frame has the general shape of a rectangular "C" with each side formed with an integral corner region connecting each side with the next. The opening into the interior space can be selectively closed by a door panel which is connected to the main body portion by an integral hinge preferably located near the bottom of the case. Lateral sides of the door panel are provided with slide-type fasteners for selectively connecting the flanking sides of the door panel to the end walls.

The handle and shoulder strap are attached directly to the frame preferably by rivets, thus forming a very secure attachment to the main case body portion.

DETAILED DESCRIPTION OF THE PREFERRED EMBODIMENT

Figure 1:
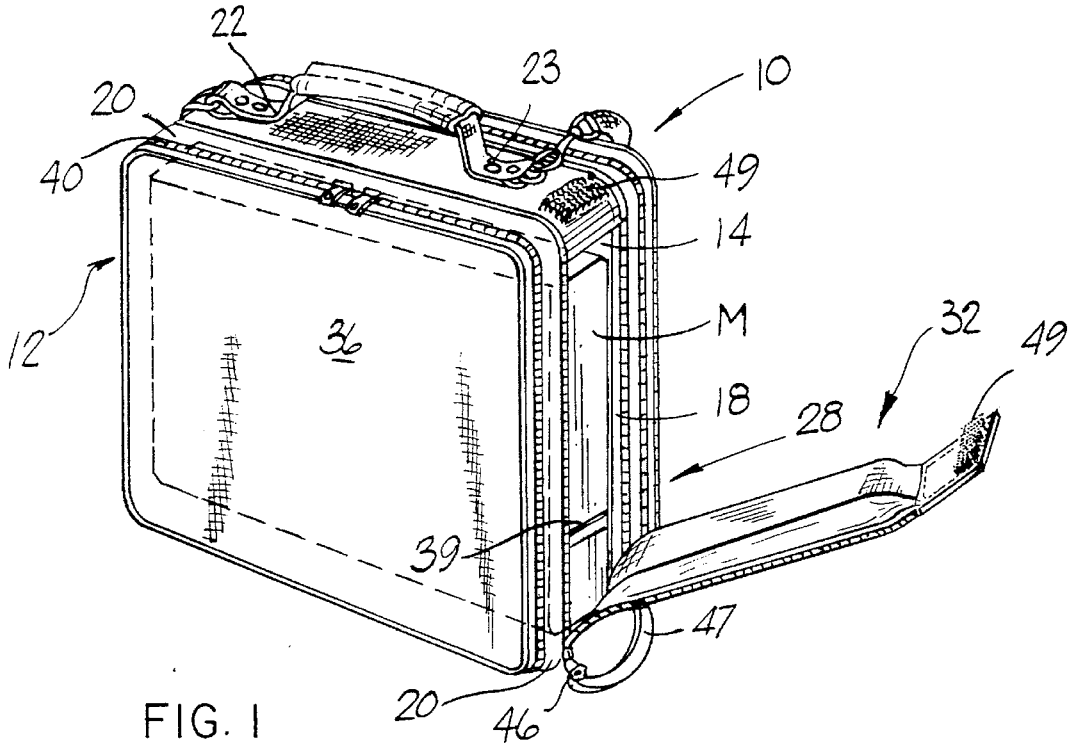
FIG. 1 is a perspective view of a preferred embodiment of the microcomputer carrying case according to the instant invention.

Referring first to FIGS. 1 through 4, a microcomputer carrying case 10 has a generally parallelopiped shape since most microcomputers have a generally similar shape. Thus the main packing compartment or interior space 14 has a shape which echoes this shape for efficient space usage and best protection of the microcomputer, as will be detailed.

Handle means 22, here shown as a strap handle and conventional shoulder strap, is firmly attached to the upper portion 24 of the main body 12.

Figure 3:
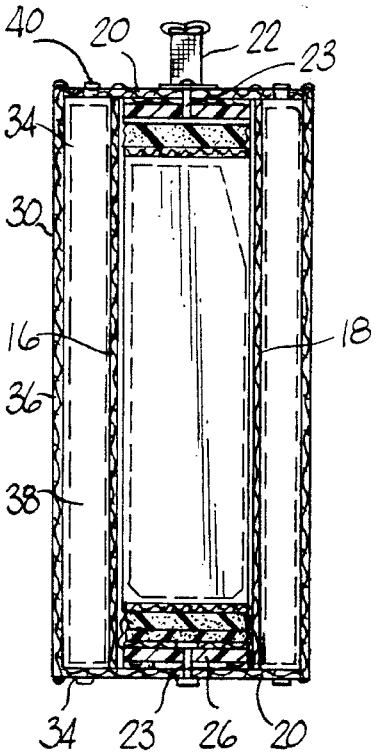
FIG. 3 is a sectional view along line 3—3 shown in FIG. 2.

The construction of this main body and its precisely defined interior space 14 is best seen in FIG. 3. Here, a first end wall 16 and second end wall 18 define the major faces of this interior space 14. These end walls are spaced from one another and interconnected by peripheral walls 20 which extend around the four sides of the main body 12. In their simplest form, these first and second end walls can be defined by or constructed of simple cloth panels or cloth panels which include a compressible shock absorbing material such a thin layer of foam. Most preferably, one or both of these end walls are flanked by further construction. In particular, the first end wall 16 has extending therefrom a cloth gusset 34 which runs around the outer edge of the end wall and parallels the peripheral walls 20. A further cloth wall 36 is attached by conventional means to this cloth gusset 34, and an access means 40, which is a typical slide fastener, divides the cloth gusset 34 and provides access to the pocket 38 provided by these additional constructions.

The user would be expected to place papers, books, magazines, etc., in this pocket. This material would further enhance the protection provided by the carrying case to the microcomputer contained in the interior space 14.

Just within the peripheral walls 20 a rigid frame 26, which preferably has an overall rectangular "C" shape, provides structural rigidity and defines the rectangular shape to receive the microcomputer M. This frame is preferably made of a thermoplastic extrusion with a honeycomb construction (FIG. 4) and is a conventional construction material for softside luggage cases. This frame includes three continuous sides, each integrally attached to one another by integrally formed corner regions 42. These corner regions obviously interconnect the top and bottom sides with the end side spanning the distance between these two. Also note there is a corner region 42 included at the distal end of the bottom side as well as the distal end of the top side above and below the open side 28. These integral corner regions flank the top and bottom of the access opening 25 through which the microcomputer passes. A relatively large access door is attached by integral hinge portion 48 just below the integral corner region 42 adjacent thereto. Slide fasteners 46, which are preferably provided with a strap 47 for simultaneous operation thereof, releasably attach the flanking or lateral walls of the access door to corresponding edges of the first and second end walls. For added security, a hook and loop type fastener 49 is provided to the distal end of the access door 44. A length of elastic webbing 39 is fastened across the open side 25 located about one third up from the integral hinge 48. This webbing is stitched to the front and back walls. This webbing is easily stretched down to permit the microcomputer to be inserted past it and into the interior space 14. The webbing 39 immediately springs back into place to help prevent the microcomputer from sliding back out in the event the user fails to seal the access door 44 with either the slide fasteners 46 or the hook and loop fasteners 49. Of course, a cloth covered panel of compressible fill extends the width and length of the access door 44. This provides some impact absorbing capability when the access door 44 is in its closed condition around the microcomputer M.

Figure 2:
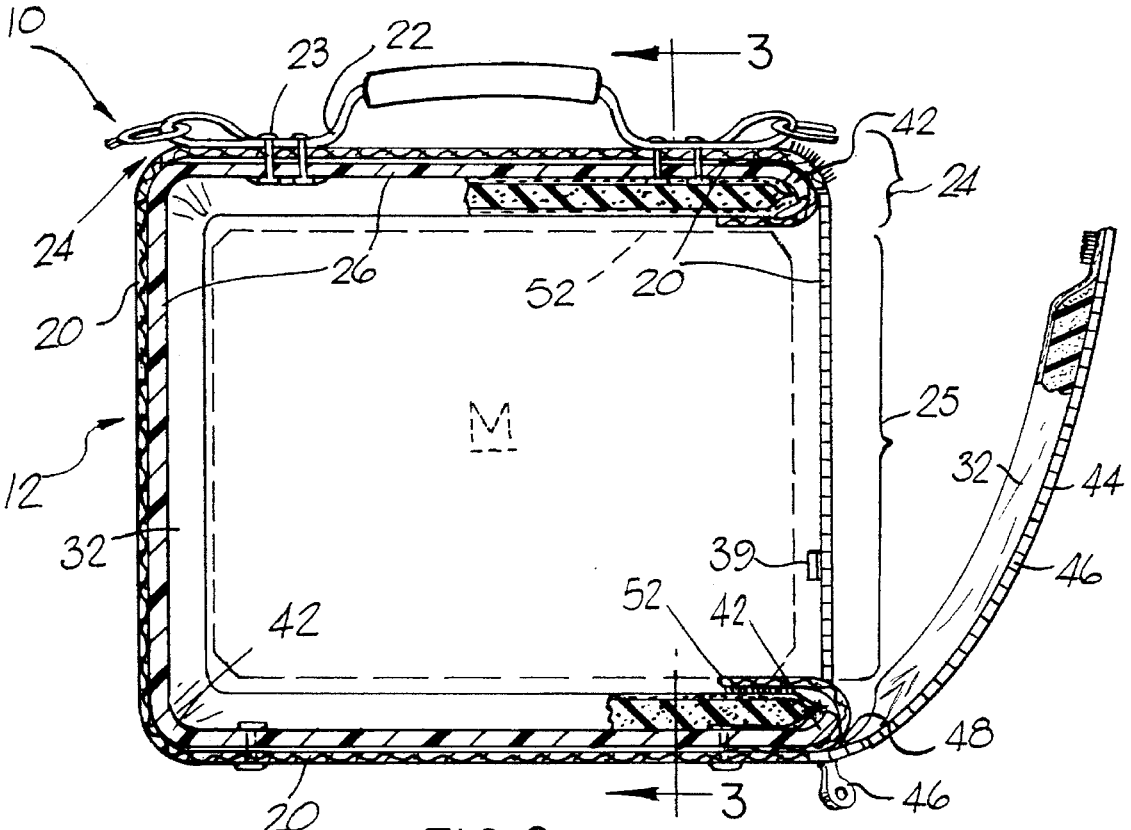
FIG. 2 is a sectional view of the microcomputer carrying case along the central axis of the case.
Figure 4:
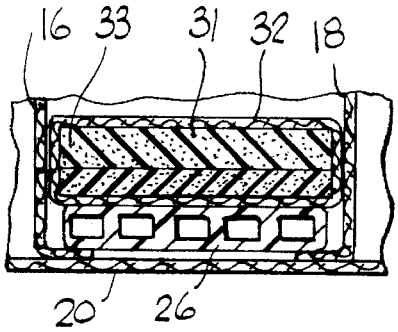
FIG. 4 is a cross section of a detail of the construction of the case.

Referring to FIG. 4, the thermoplastic frame 26 extends around the inside surface of the cloth panels making up the main body portion. Flanking first and second ends walls are to either side of this frame 26. Rivets, such as rivets 23, firmly attach the frame 26 to these cloth panels. The shock absorbing pad 31 preferably comprises an elongated tubular-shaped membrane 32, here shown as a tightly woven cloth tube 32. A compressible fill 33, such as multiple layers of closed cell foam having different densities within this tubular membrane 32, together with the rigid frame 26, define a secure and shock absorbing system. As best seen in FIG. 2, this shock absorbing pad has an overall length which substantially corresponds to the length of the rigid frame sides and integral corners. This shock absorbing pad fits snugly within the frame. The ends thereof are held into position by extensions 52 of the cloth layers making up the main body. These are looped back over the ends and held in place by further hook and loop or other releasable fasteners. Thus, the microcomputer which will probably fit snugly within this interior space 14, and slide easily in and out without inadvertently removing the shock absorbing pad. Also, the corner regions 42 at the distal ends of the top and bottom sides of the generally "C" shaped rigid frame further cradle the pad (and thus the microcomputer contained therein as will be further detailed), to further define a secure and convenient construction.

The shock absorbing pad could also comprise a gas impermeable fabric envelope, (rather than a cloth tube.) In this case, the fill 33 would comprise air or other gas under pressure. Such construction would eliminate some or all of the layers of closed cell foam shown within the shock absorbing pad 31 in the drawings, yet help insulate the microcomputer M from severe mechanical shocks.

The operation of the carrying case 10 will now be detailed. In the position shown in FIG. 1, a microcomputer M can be easily slid into the interior space 14 of the main body 12. The access door 44 is hinged on its integral hinge portion 48 to bring the hook and loop fasteners 49 into engagement. For further security, the slide fasteners 46 are simultaneously pulled up along the flanking walls of the access door 44. Further materials in the pocket or pockets to either side of the first and second end panels further cradle the microcomputer. In this position, the microcomputer M is surrounded by a rigid frame 26 on all but the open side 28, and a shock absorbing pad or pads around all the peripheral walls 20 of the main body portion. The first and second ends are protected by the multiple cloth walls, magazines, books, etc., and thin compressible foam panels if necessary.

To remove the microcomputer is extremely simple and obvious to any user. The user doesn't even need to set the case down. Rather the user can continue to hold on to the handle or keep the shoulder strap of the handle means 22 on one shoulder while releasing the hook and loop fasteners, pulling the laterally positioned slide fasteners 46 down and pulling the microcomputer from the interior space 14.

Thus, the positioning of the access opening 25 into the interior space 14 for inserting and removing the microcomputer through one of the peripheral walls (rather than the top or one of the end walls) has superior convenience and safety aspects. The user need not fumble with extra straps, slings and the like. Indeed, the user need not let go of the handle or remove the carrying strap from the user's shoulder, thus reducing the chances that the case, with the microcomputer only partially removed, could fall from a desk, table or chair. The user can position the microcomputer in a secure manner on a desk (or indeed, on the user's lap) before dealing with the carrying case 10.

In tests, this construction has been shown to be as good as or superior to many of the leading microcomputer cases being currently offered. Indeed, the preferred embodiment can protect the microcomputer, not only from severe impact resulting from dropping the case on its bottom surface from a height of 30 inches, but also from dropping the case from that height on any of its peripheral walls, as well as the first and second end walls-all this without making the case heavier than a typical computer case, and certainly with enhanced convenient loading and unloading the microcomputer.

Figure 5:
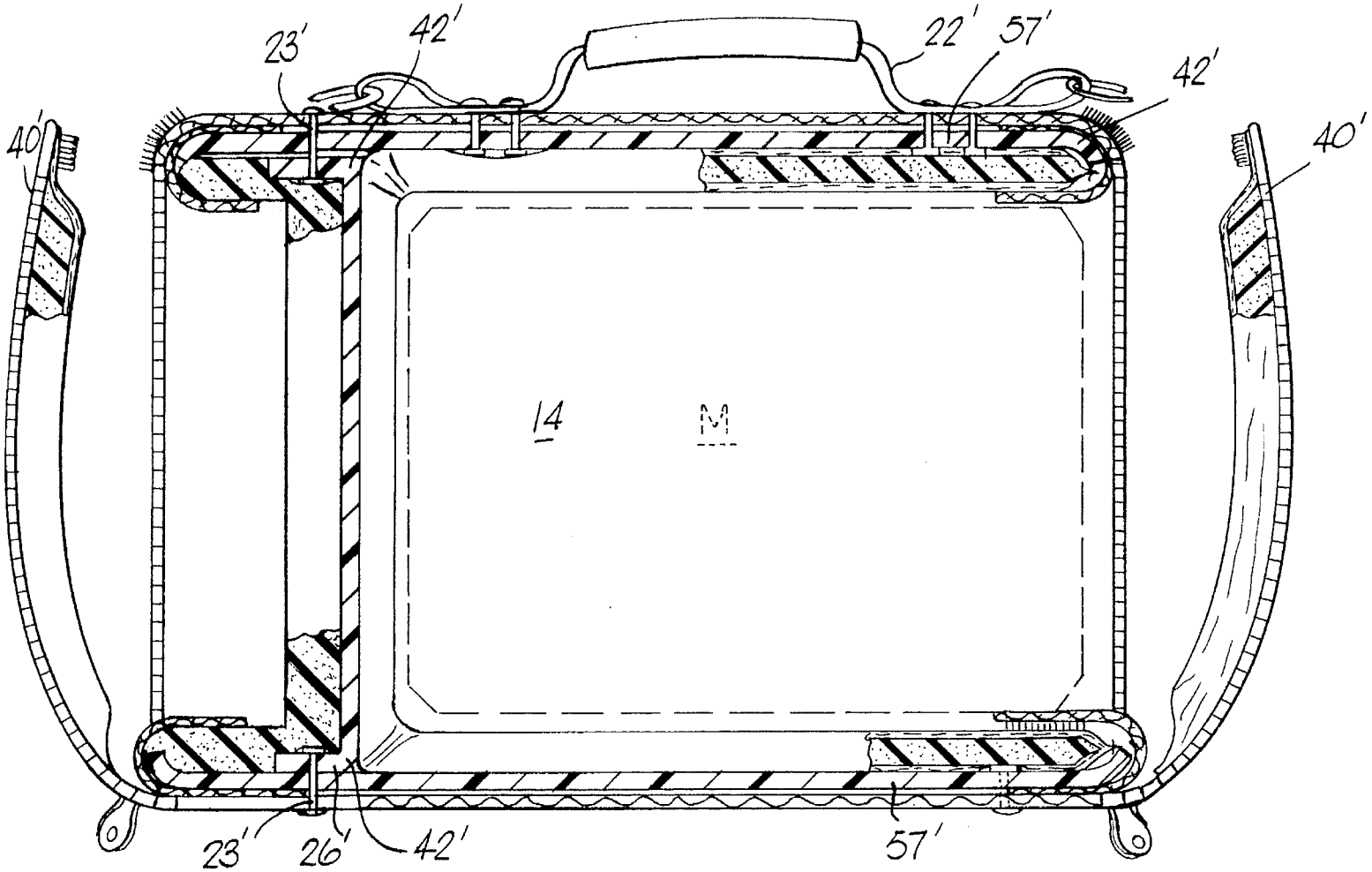
FIG. 5 is a cross sectional view similar to FIG. 2 of an alternative construction.

FIG. 5 shows an alternative construction with further convenience and security features. Corresponding structures are indicated by corresponding reference numerals. Here, the "C" shaped frame is complemented by upper and lower frame portions 57 and 57. Rivets 23' attach these various frame portions together, as well as attach the handle means 22' as in the previous embodiment. Integral corner regions 42' not only are a part of the "C" shaped frame 26', but as in the previous embodiment, flank the bottom and top edges of the access openings into the main packing compartment or interior space 14.

Here, as is obvious from FIG. 5, this interior space 14 is divided into two compartments, one sized to fit a microcomputer M, the other sized to receive a cellular phone, a cassette recorder or other generally parallelopiped, heavy, and expensive electronic equipment. This alternative construction thus provides two secure and shock absorbing containers, each accessible by a side access door 44', substantially identical to that detailed with regard to the embodiment of FIGS. 1 through 4. Operation of this embodiment will not be further detailed as it is identical (except for the extra functionality provided by two access doors 44') to the above preferred construction.

Figure 6:
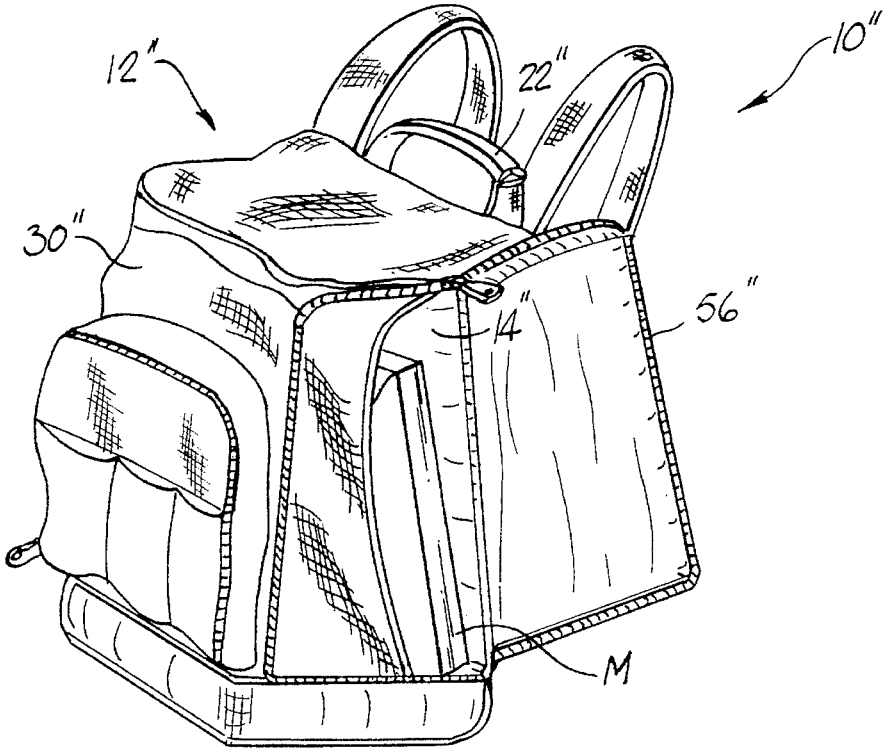
FIG. 6 is a further alternative showing the microcomputer carrying case in the form of a backpack.

FIG. 6 shows a further modification of the preferred embodiment. Here, rather than a briefcase or business case configuration, the construction detailed in FIG. 2 is contained within a backpack or day pack main body 12". Handle means 22" here are a carrying handle and a shoulder strap which are attached to the upper portion thereof. Access door 56 differs slightly from the access doors of the Other embodiments in that the integral hinge portion is all along the second end wall 18 of the interior space 14" and extends to the cloth panel 30" rather than to the first end panel thereof. Other than this change, the overall construction, including rigid frame, tubular cloth membrane with its compressible fill, and other details which lead to the superior shock protection and accessibility of the previous embodiments, are also contained in this alternative construction.

The term microcomputer is used throughout, but this term should not be limited to the present general purpose keyboard input computing devices. Any relatively heavy, relatively delicate portable instrument which is normally carried from one location to another and used by the person carrying the instrument can benefit from this invention.

We claim:

1. A carrying case for a portable electronic device, the case having a main body portion having an interior space to hold the electronic device, the interior space being defined by a first end wall, a second end wall, and peripheral walls extending between the first and second end walls, handle means for carrying the case attached to an upper portion of the main body portion, an opening into the interior space through which the electronic device can be moved, the improvement comprising a frame having three generally straight sides and an open side, the frame being made of a generally stiff material with the sides of the frame at least partially surrounding the interior space along the peripheral walls, the open side positioned below the upper portion when the case is being carried by the handle means, and said opening into said interior space located at said open side of said frame.

2. A carrying case as set forth in claim 1 wherein said first end wall comprises a cloth panel.

3. A carrying case as set forth in claim 2 further including a peripheral cloth gusset extending from said first end wall outwardly away from said interior space, and an outermost cloth wall forming an outer covering for said carrying case, said first end wall, said peripheral cloth gusset, and said outermost wall defining a pocket, and access means through an upper portion of said peripheral cloth gusset for permitting access to said pocket.

4. A carrying case as set forth in claim 1 wherein said second wall comprises a cloth panel and a shock absorbing pad.

5. A carrying case as set forth in claim 1 wherein said frame comprises a plastic extrusion, the three sides thereof formed of lengths of said extrusion with corner regions, the open side of the frame flanked by corner regions.

6. A carrying case as set forth in claim 1 further including a shock absorbing pad extending around the frame in said interior space.

7. A carrying case as set forth in claim 6 wherein said shock absorbing pad comprises a tube shaped membrane positioned around a shock absorbing media, said tube shaped membrane having a length substantially equal to the total length of the three sides and the integral corner regions of said frame.

8. A carrying case as set forth in claim 7 wherein said shock absorbing media is a closed cell foam.

9. A carrying case as set forth in claim 7 wherein said shock absorbing media comprises at least two layers of material having shock absorbing characteristics different from one another.

10. A carrying case as set forth in claim 7 wherein said tube shaped membrane is gas impermeable, and said shock absorbing media comprises a pressurized gas.

11. A carrying case as set forth in claim 6 further including fabric covering comprising at least a portion of said peripheral walls, a portion of said fabric covering extending into said interior space at the integral hinge, wrapping up over an end of said shock absorbing layer at the lower corner of the interior space.

12. A carrying case as set forth in claim 1 wherein the frame has a shape of a C and each side thereof is integrally formed with a corner region and each side is connected by a corner region to a next side.

13. A carrying case as set forth in claim 1 wherein at least one of said peripheral sides of said main body comprises access means for selectively opening and closing said opening into said interior space, said access means comprises a door panel connected to said main body by an integral hinge portion, and selectively attached by slide type fasteners for selectively connecting flanking sides of said door panel to said first end wall and said second end wall.

14. A carrying case as set forth in claim 1 wherein said handle means is attached directly to said frame.

15. A carrying case as set forth in claim 1 wherein said handle means is attached directly to said frame by rivets.

16. A carrying case as set forth in claim 1 wherein one side of the three sides of the frame is spaced inward from a corresponding peripheral wall of the main body portion, said corresponding peripheral wall comprising a second access means for accessing interior space between said corresponding peripheral wall and said one side of the frame.

17. A carrying case as set forth in claim 16 wherein said second access means comprises a door panel connected to said main body by an integral hinge portion, and selectively attached by slide type fasteners for selectively connecting flanking sides of said door panel to said first end wall and said second end wall.

* * * * *